United States Patent [19]

Armstrong et al.

[11] Patent Number: 4,549,959

[45] Date of Patent: Oct. 29, 1985

[54] PROCESS FOR SEPARATING MOLYBDENITE FROM A MOLYBDENITE-CONTAINING COPPER SULFIDE CONCENTRATE

[75] Inventors: Raynor O. Armstrong; Daniel A. Norrgran; William A. Yuill, all of Tucson, Ark.

[73] Assignee: Atlantic Richfield Company, Los Angeles, Calif.

[21] Appl. No.: 656,201

[22] Filed: Oct. 1, 1984

[51] Int. Cl.[4] ..... B03D 1/14

[52] U.S. Cl. ..... 209/167; 75/2

[58] Field of Search ..... 209/166, 167; 75/2

[56] References Cited

U.S. PATENT DOCUMENTS 2,492,936 12/1949 Nokes et al. ..... 209/167
4,329,223 5/1982 Ramadorai ..... 209/167

FOREIGN PATENT DOCUMENTS 1070034 1/1980 Canada ..... 209/167
144756 11/1981 Japan ..... 209/167

*Primary Examiner*—Bernard Nozick
*Attorney, Agent, or Firm*—F. Lindsey Scott

[57] ABSTRACT

A process for selectively separating molybdenum from a molybdenite-containing copper sulfide concentrate by a flotation process wherein the molybdenite is selectively floated by the use of a sulfite or bisulfite compound as a copper sulfide depressant.

19 Claims, 1 Drawing Figure

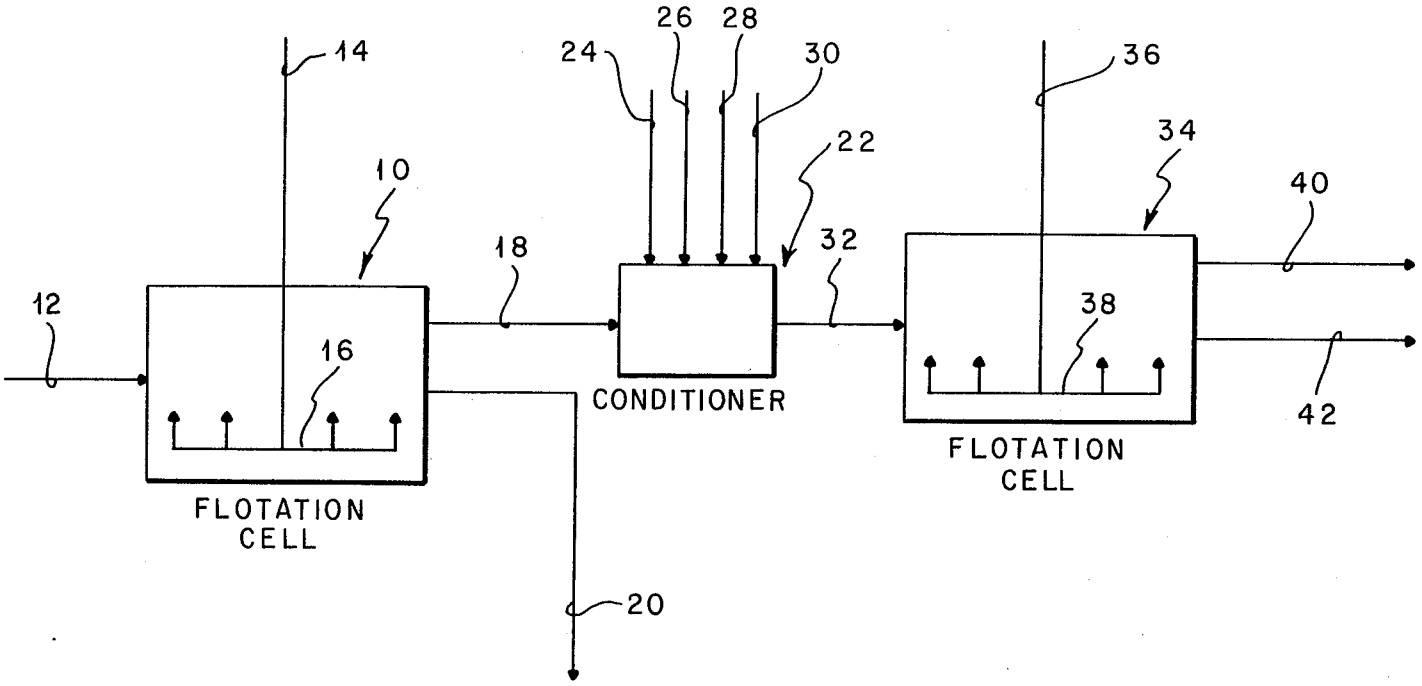
12
14
10
16
FLOTATION CELL
18
20
24
26
28
30
22
32
CONDITIONER
36
34
38
FLOTATION CELL
40
42

PROCESS FOR SEPARATING MOLYBDENITE FROM A MOLYBDENITE-CONTAINING COPPER SULFIDE CONCENTRATE

This invention relates to processes for selectively separating molybdenite from a molybdenite-containing copper sulfide concentrate by a flotation process wherein the molybdenite is selectively floated by the use of a sulfite or bisulfite compound as a copper sulfide depressant.

Molybdenite commonly occurs in copper bearing ores. When such ores are beneficiated by conventional froth floatation processes using flotation agents such as xanthates and dithiophosphates, the molybdenite floats with the copper sufide and iron sulfide minerals. In some instances, copper may be the primary value in such ores although in other instances significant quantities of molybdenite are also present. Recovery of the molybdenite has been accomplished through processes for selectively separating the molybdenite from the molybdenite-containing copper sulfide concentrates produced in the primary beneficiation step.

Essentially in these processes, the separation of molybdenite from the copper sulfides present in the concentrate is accomplished by either depressing the molybdenite with certain reagents while floating the copper sulfides or conversely by depressing the copper sulfides while floating the molybdenite. The processes presently known however involve the use of expensive reagents as well as extensive processing which often includes special treatment steps such as roasting or steaming.

Several processes are well known in which the copper minerals are depressed and the molybdenite floated for separation by froth flotation techniques. These processes include the use of ferrocyanide-cyanide processes in which the copper minerals are depressed with sodium ferrocyanide and subsequently depressed with sodium cyanide while the molybdenite is floated using fuel oil and alcohol frothers. Copper minerals may also be depressed with sodium hypochloride and sodium ferrocyanide while allowing the molybdenite to be floated using fuel oil as a frothing agent. Caustic soda and phosphorous pentasulfide have also been used to depress the copper minerals of a sulfide ore and to separate the copper minerals from the molybdenite. Nokes reagents such as discussed in U.S. Pat. No. 2,492,936 have also been used for such separations. These as well as other processes known to those skilled in the art involve the use of expensive reagents and processing steps which are both uneconomical and difficult to handle.

Processes in which the molybdenite is depressed from the copper minerals are also well known. Included in these are the use of a soluble dextrine which causes the depression of the molybdenite and allows for the copper minerals to be floated using such materials as ethyl xanthate as a collector. Other protective organic colloids such as starch, glue, dextrose, gelatin, whey, casein, and the like as disclosed in U.S. Pat. No. 3,070,076 are also known to have the effect of inhibiting the flotation of molybdenite and allowing separation from copper sulfides. These agents, however, also inhibit the flotation of non-metallic materials such as mica, talc, and the like and therefore processes using them produce relatively low concentrations of the molybdenite in the resultant tailings and are susceptible to breakdown under variations of concentration of the non-metallic materials.

Molybdenite has also been separated from copper sulfide and insolubles by spray-dryer techniques.

Accordingly, a continuing search has been conducted to develop more effective and efficient ways of separating molybdenite from molybdenite-containing copper sulfide concentrates.

It has now been found that molybdenite is effectively separated from molybdenite-containing copper sulfide concentrates in a flotation process by selectively floating the molybdenite by use of a sulfite or a bisulfite compound as a copper sulfide depressant wherein the process comprises:

(a) adjusting the pH of the concentrate to a value from about 30 to about 7.0 and the concentration of the copper sulfide depressant to a value sufficient to inhibit the flotation of copper sulfides in the concentrate upon aeration of the concentrate;

(b) aerating the concentrate to float the molybdenite; and, (c) separating the floated molybdenite from the concentrate.

The sulfite or bisulfite compound may be formed in situ in the concentrate by contacting the concentrate with sulfur dioxide.

The sulfite or bisulfite compound may be added to the concentrate in the form of alkali metal sulfite or bisulfite with the pH of the concentrate being adjusted to a desired value by the use of sulfuric acid.

The FIGURE is a schematic diagram of an embodiment of the process of the present invention.

In the FIGURE a molybdenite-containing copper sulfide ore is charged to a flotation cell 10 through a line 12 with air being provided to flotation cell 10 through a line 14 and a distributor 16. Flotation cell 10 may be of a variety of types known to those skilled in the art for intimately contacting air bubbles with a concentrate which has been conditioned for froth flotation. A variety of designs are known for such cells and many of the known types of cells will be found effective for the separation to be accomplished in cell 10. In cell 10 the feed stream charged through line 12 is typically a finely divided ore stream which is beneficiated to recover by flotation a beneficiated concentrate stream through a line 18. The mineral concentration of the stream recovered through line 18 will have been increased substantially over the mineral concentration in the stream fed to flotation cell 10 through line 12. The gangue minerals are discharged through a line 20, passed to further treatment or the like as may be appropriate. Such separations for the rough beneficiation of ore are well known to those skilled in the art and do not require discussion in detail. The molybdenite-containing copper sulfide concentrate recovered through line 18 is passed to a conditioner 22 where it is conditioned preparatory to the selective flotation of molybdenite from the copper sulfide concentrate in a second flotation cell 34. The pH of the concentrate is adjusted in conditioner 22 to a value from about 3.0 to about 7.0 and the concentration of the copper sulfide depressant is adjusted to a value sufficient to inhibit the flotation of copper sulfides in second flotation cell 34. After adjustment of the pH and the copper sulfide depressant concentration to desired values, the conditioned concentrate is passed through a line 32 to second flotation cell 34 where air is injected through a line 36 to produce bubbles via a distributor 38 and subjected to froth flotation to produce a molybdenite-rich overflow stream recovered through a line 40 and a copper sulfide-rich stream recovered through a line 42. Both these streams may be passed to further processing to increase the concentration of molybdenite or copper sulfide respectively. The stream recovered through line 40 may be subjected to additional conditioning and treatment by the same process used in flotation cell 34 or other copper sulfide depressant materials such as sodium hydrosulfide and the like may be used. Similarly, the copper sulfide rich stream recovered through line 42 may be passed to additional processing to further increase the copper sulfide concentration. Such processing may involve flotation of the copper sulfide away from remaining non-metallic constituents of the stream and the like as well known to those skilled in the art.

According to an embodiment of the present invention, the molybdenite-containing copper sulfide concentrate charged to conditioner 22 through line 18 is adjusted in conditioner 22 to a pH value from about 3.0 to about 7.0 by contacting the concentrate with sulfur dioxide added through a line 24. This contacting may be a variety of techniques known to those skilled in the art such as bubbling the sulfur dioxide into the concentrate a suitable distance beneath the surface so that the sulfur dioxide is absorbed into the concentrate and the like. The sulfur dioxide forms sulfite or bisulfite compounds according to well known equilibrium relationships in the concentrate in conditioner 22. When the pH value has been adjusted to the desired range by addition of the sulfur dioxide, it has been found that the sulfite or bisulfite compound concentration in the concentrate is at a suitable level to effectively inhibit the flotation of copper sulfides in second flotation cell 34. Preferably the pH value is from about 5.0 to about 6.0 and particularly desirable results have been achieved at a pH value from about 5.4 to about 5.6. It may also be desirable is some instances to add quantities of activated carbon to conditioner 22 via line 30 or to second flotation cell 34. While it is not necessary that activated carbon be used in all instances and while Applicants do not wish to be bound by any particular theory, it appears that the activated carbon may function as discussed in U.S. Pat. No. 4,268,380 (column 11, lines 50–64) to further enhance the flotability of the molybdenite relative to the copper sulfides. The activated carbon may be used in varying amounts as required.

In a further embodiment of the process of the present invention, the pH of the concentrate is adjusted in conditioner 22 by the addition of sulfuric acid through a line 26. The pH is desirably adjusted to a value from about 3.0 to about 7.0. An alkali metal sulfite or bisulfite compound such as sodium sulfite or sodium bisulfite is then added through a line 28. While a variety of alkali metal sulfites or bisulfites may be used, sodium is greatly preferred because of its more readily availability and its lower costs. Typically, the sodium sulfite or bisulfite is added in an amount from about 1 to 5 pounds per ton of solids in the concentrate. The pH is preferably adjusted to a value from about 5.0 to about 6.0 and very desirable results have been accomplished when the pH is from about 5.4 to about 5.6. Activated carbon may also be used in this embodiment of the invention as discussed previously.

In both embodiments of the invention discussed above, it may be desirable to add an additional quantity of a suitable frother, such as 4-methyl-2-pentanol (methyl isobutylcarbinol—MIBC), to the concentrate prior to charging it to second flotation cell 34.

As discussed above, the present invention results in the selective separation of molybdenite from molybdenite-containing copper sulfide concentrates using relatively inexpensive reagents in relatively small quantities.

EXAMPLE I

A sulfur dioxide separation process was tested using an ore which, as mined, averages 0.10 weight percent molybdenum and 0.08 weight percent copper. This ore is milled to 20 weight percent plus 65 Tyler mesh to liberate the sulfide minerals and subjected to a bulk sulfide flotation stage to selectively collect the copper and molybdenum minerals.

In the bulk flotation process, the milled ore is diluted with water to about 25 to 40 weight percent solids. The pulp is then conditioned with from 0.01 to 0.10 lb of flotation collector per ton of ore. Common flotation collectors include xanthates, dithiophosphates, xanthogen formates, and thionocarbamates. These are anionic collectors containing a polar and a non-polar hydrocarbon group which selectively coat the sulfide minerals with an aerophilic film and are consequently attracted to any available air-water interphase. When air is dispersed in the flotation cell, the sulfide particles will attach to a bubble and be carried to the surface and collected in a launder. This process is represented in the schematic in the first flotation cell (10). Lime is added to the milling stage to maintain a flotation pH of 10 to 11 which depresses unwanted iron sulfides. A frother is also employed to stabilize the bubbles and aid in mineral collection. In plant practice, the collection of bulk sulfide concentrate is commonly carried out in several banks of rougher and cleaner flotation cells. Regardless of the number of cells or stages used, the resultant products are a sulfide mineral concentrate and a tailing.

A high ratio of concentration is established in the bulk sulfide flotation stage. The ore is typically upgraded from 0.10 weight percent molybdenum and 0.08 weight percent copper to 20 weight percent molybdenum and 12 weight percent copper. As a consequence of this high concentration ratio, the tailings product typically contains in excess of 98 percent of the feed weight and as low as one-tenth the metal content.

The bulk flotation procedures described above are commonly used in the minerals industry.

The bulk copper-molybdenum concentrate is then subjected to a separation stage to produce a separate copper and a separate molybdenum concentrate. To initiate the copper-molybdenum separation, the bulk copper-molybdenum concentrate was conditioned with sulfur dioxide. This is depicted in the FIGURE as conditioner (22). Sulfur dioxide was sparged into the conditioner in its gaseous state until the pH stabilized at 5.5. This required 16 lb of sulfur dioxide per ton of bulk copper-molybdenum concentrate. Sulfur dioxide reacts with the water in the flotation pulp to form sulfurous acid ($H_2SO_3$) which depresses copper sulfide minerals. Conditioning was then carried out at ambient temperature (20° to 30° C.) for approximately 10 minutes (which corresponds to the residence time in the conditioner). The conditioned mineral pulp was then discharged into a flotation cell to perform the separation of the molybdenum minerals from the copper minerals. Air was dispersed into the flotation cell and the molybdenum-laden froth was collected. The copper minerals remained in the flotation cell. In the FIGURE the molybdenum product is represented as stream 40 while the copper product is represented as stream 42. This test was conducted in a production facility on a continuous basis over a period of 8 hours. Aproximately 5000 tons of ore and 20 tons of bulk copper-molybdenum concentrate were treated. The results of this test are shown in Table I. The streams are numbered to correspond to the FIGURE.

The separation efficiency shown in the Table I represents the amount of each metal recovered in the initial concentration stage or subsequent separation stage. The test results indicate that 86.8 weight percent of the molybdenum and 74.2 weight percent of the copper were recovered in the bulk copper-molybdenum concentrate. The remaining metal values were lost to the tailings. After the copper-molybdenum separation stage on the bulk copper-molybdenum sulfide concentrate, 99.5 weight percent of the molybdenum in the bulk concentrate was recovered in the molybdenum sulfide concentrate and 71.7 weight percent of the copper in the bulk concentrate was recovered in the copper sulfide concentrate. At the production facility, the molybdenum separation product is subjected to an additional series of flotation stages using sodium hydrosulfide to further reduce the copper to less than 0.5 weight percent in the final molybdenum sulfide concentrate. The copper so rejected in these flotation stages reports to the copper sulfide concentrate which increases the overall copper separation efficiency to a value in excess of 99 weight percent.

This test conclusively demonstrates that sulfur dioxide is an effective depressant for copper sulfide minerals.

TABLE I

METALLURGICAL RESULTS OF COPPER-MOLYBDENUM SEPARATION TEST EMPLOYING SULFUR DIOXIDE

| Product | Weight Percent | Percent Mo | Percent Cu | Separation Efficiency (%) Mo | Separation Efficiency (%) Cu |
|---|---|---|---|---|---|
| Mill Feed (ore) (12) | 100.00 | 0.100 | 0.080 | | |
| Bulk Tails (20) | 99.57 | 0.013 | 0.021 | | |
| Bulk Cu-Mo Concentrate (18) | 0.43 | 20.20 | 13.80 | 86.80 | 74.20 |
| Mo Separation Concentrate (40) | 0.24 | 35.90 | 6.00 | 99.50 | |
| Cu Separation Concentrate (42) | 0.19 | 0.25 | 22.40 | | 71.70 |

EXAMPLE II

A sample of bulk copper-molybdenum concentrate containing 25.9 weight percent molybdenum and 11.3 weight percent copper was used for additional flotation test work. The sample was subjected to locked-cycle laboratory flotation tests in order to compare the various metallurgical aspects when replacing the commonly used sodium hydrosulfide with sulfur dioxide in the copper-molybdenum separation stage. In the first test, sulfur dioxide was used to perform the copper-molybdenum separation. In the second test, sodium hydrosulfide was used exclusively.

The initial stage in the process is the conditioning of the bulk copper-molybdenum concentrate to depress the copper minerals. In the first test, the copper-molybdenum concentrate was placed in a flotation cell and diluted with water to 30 percent solids. Sulfur dioxide was then sparged into the pulp until the pH reached 5.5. (This required 4.0 lb/ton of sulfur dioxide.) The pH was maintained at 5.5 for 5 minutes while the pulp was agitated. After this conditioning stage, air was injected into the flotation cell and the molybdenum-laden froth was collected. The copper minerals remained in the flotation cell. In a second test, the copper-molybdenum concentrate was placed in a flotation cell, diluted to 30 percent solids, the pH adjusted to 11.0 with lime, and conditioned with sodium hydrosulfide until an oxidation-reduction potential of −550 mv was reached. This corresponds to the operational parameter utilized in production operations. Air was then injected into the flotation cell and the molybdenum-laden froth collected. As in the first test, the copper minerals remained in the flotation cell. A scavenger flotation stage was implemented to collect residual molybdenum from the copper minerals into a low-grade concentrate and return it to the head of the separation circuit. In the first test, this scavenger flotation stage was conducted at a pH of 5.5 still utilizing the sulfur dioxide from the separation stage. In the second test, the oxidation-reduction potential was maintained at −550 mv using sodium hydrosulfide during the scavenger flotation stage. The scavenger flotation cell product from each test represents the final copper concentrate. The molybdenum product from the separation stage was, in turn, reground (to further establish liberation) and subjected to a first cleaner flotation stage to further upgrade the molybdenum product. In the first test, the cleaner flotation separation was conducted while the sulfur dioxide from the separation stage still exhibited a depressive effect (ph 6.0–6.5) on the copper minerals. In the second test, the cleaner flotation stage was conducted at an oxidation-reduction potential of −550 mv using sodium hydrosulfide. In each test the cell product, containing a relatively high amount of copper, was returned to the conditioner prior to the separation stage in an attempt to recover this copper in the copper concentrate.

These tests also incorporated an additional regrind stage followed by four additional flotation stages to further upgrade the molybdenum concentrate. In each test this process was carried out in the same manner using sodium hydrosulfide. Lime was added to the second regrind mill to establish a pH of 11.5. The pulp was then subjected to a series of four cleaner flotation stages using sodium hydrosulfide in each stage to maintain an oxidation-reduction potential of −550 mv. Due to the aeration during flotation, the sodium hydrosulfide oxidizes, thus raising the oxidation-reduction potential toward positive, therefore sodium hydrosulfide is added frequently during each flotation stage to maintain the oxidation-reduction potential at −550 mv. The tailings from the second and fourth cleaner flotation stages contain significant quantities of copper and are cycled back to the first cleaner for copper recovery. The tailings products from the third and fifth cleaner flotation stages are cycled to the second and fourth cleaners, respectively. This process flowsheet simulates production operations. This labortory procedure was carried through eight cycles in each test to ensure equilibrium and to simulate plant production. Throughout the test work the sodium hydrosulfide and sulfur dioxide additions were measured in order to quantify comsumptions.

The metallurgical results of the test work and the reagent consumptions are shown in Table II.

TABLE II

METALLURGICAL RESULTS OF COPPER-MOLYBDENUM SEPARATION AND UPGRADING/COMPARISON TESTS USING COMBINED SULFUR DIOXIDE-SODIUM HYDROSULFIDE VS SODIUM HYDROSULFIDE

| Product | Weight* Percent | Percent* Mo | Percent* Cu | Recovery* Percent Mo | Recovery* Percent Cu | Reagents Used |
|---|---|---|---|---|---|---|
| Final Molybdenum Concentrate | 51.6 | 49.8 | 0.69 | 99.1 | 3.2 | Sulfur Dioxide 4.0 lbs/ton |
| Final Copper Concentrate | 48.4 | 0.47 | 22.2 | 0.9 | 96.8 | Sodium Hydrosulfide 46.7 lb/ton |
| Final Molybdenum Concentrate | 51.5 | 50.0 | 0.50 | 99.2 | 2.3 | Sodium Hydrosulfide 119.6 lb/ton |
| Final Copper Concentrate | 48.5 | 0.45 | 23.0 | 0.8 | 97.7 | |

*Recovery based on metal values contained in the bulk copper-molybdenum sulfide concentrate.

As shown in Table II, the first test required 4.0 lb/ton sulfur dioxide and 46.7 lb/ton of sodium hydrosulfide. The final molybdenum concentrate contained 49.8 weight percent molybdenum representing a 99.1 weight percent molybdenum recovery. The final copper concentrate contained 22.2 weight percent copper representing a 96.8 percent copper recovery.

The second test was conducted exactly as the first test with the exception that sodium hydrosulfide was used exclusively. A total of 119.6 lb/ton sodium hydrosulfide was required. The final molybdenum concentrate contained 50.0 weight percent molybdenum representing a 99.2 weight percent molybdenum recovery. The final copper concentrate contained 23.0 weight percent copper representing a 97.7 weight percent copper recovery.

The metallurgical results from the two tests are very nearly identical. In the first test, the auxiliary sulfur dioxide decreased the total sodium hydrosulfide consumption to less than half that required in the second test. On a cost basis where sulfur dioxide costs $0.14/lb and sodium hydrosulfide costs $0.30/lb, treating a ton of bulk copper-molybdenum concentrate would cost $14.57 in the first test as compared to $35.88 in the second test.

The sulfur dioxide separation test was carried out for two weeks at a production facility treating approximately 15,000 tons of ore per day. During the plant test sulfur dioxide was sparged into the bulk copper-molybdenum concentrate (at the conditioner) to establish a pH of 5.5 to 6.0. The concentrate was then subjected to copper-molybdenum separation. The molybdenum concentrate was further upgraded in five additional cleaner flotation stages. In cleaner flotation stages 2 through 5, lime was added to maintain a pH of 11.5 and sodium hydrosulfide was added to maintain an oxidation-reduction potential of −400 mv in the second cleaner ranging down to −550 mv in the fifth cleaner. During stable operating conditions, the total sodium hydrosulfide consumption in these cleaner stages averaged less than 50 lb/ton of bulk copper-molybdenum concentrate. No reagents were added to the first cleaner flotation stage.

The results of the plant test demonstrate that the utilization of the sulfur dioxide separation system maintains the netallurgy and quality of the concentrates while significantly reducing the production costs. During the first week of the in-plant test (using sulfur dioxide), reagent costs averaged 6.2 cents per pound of molybdenum. The reagent cost decreased to an average of 5.3 cents per pound of molybdenum during the second week, and averaged as low a 4.4 cents per pound of molybdenum during the last three days of the test. Using sodium hydrosulfide exclusively, reagent costs averaged 9.6 cents per pound of molybdenum.

In summary, the plant test using the sulfur dioxide separation system was conducted over a time period of two weeks in which the concentrator treated approximately 150,000 tons of ore. The metallurgy and quality of the concentrates were essentially the same as those produced using sodium hydrosulfide prior to the plant test. The tests demonstrate that production costs are decreased by $0.05 per pound of recovered molybdenum using sulfur dioxide.

Having thus described the invention by reference to certain of its preferred embodiments, it is respectfully pointed out that the embodiments described are illustrative rather than limiting in nature and that many variations and modifications are possible within the scope of the present invention. Many such variations and modifications within the scope of the present invention may appear obvious and desirable to those skilled in the art upon a review of the foregoing examples and descriptions of preferred embodiments.

Having thus described the invention we claim:

1. A process for separating molybdenite from a molybdenite-containing copper sulfide concentrate by a flotation process wherein said molybdenite is selectively floated by use of a sulfite or bisulfite compound as a copper sulfide depressant, said process comprising:

(a) adjusting the pH of said concentrate to a value from about 3.0 to about 7.0 and the concentration of said copper sulfide depressant to a value sufficient to inhibit the flotation of copper sulfides in said concentrate upon aeration of said concentrate;

(b) aerating said concentrate to float said molybdenite; and, (c) separating said floated molybdenite from said concentrate.

2. The process of claim 1 wherein said pH value is from about 5.0 to about 6.0.

3. The process of claim 1 wherein activated carbon is added to said concentrate prior to said separation.

4. The process of claim 1 wherein said pH is adjusted by contacting said concentrate with sulfur dioxide.

5. The process of claim 4 wherein said sulfite or bisulfite compound is formed in said concentrate by contacting said concentrate with said sulfur dioxide.

6. The process of claim 1 wherein said pH is adjusted by the addition of sulfuric acid to said concentrate and wherein said copper sulfide depressant is selected from the group consisting of alkali metal sulfites and alkali metal bisulfites.

7. The process of claim 6 wherein said pH value is from about 5.0 to about 6.0.

8. The process of claim 6 wherein said copper sulfide depressant is sodium sulfite or sodium bisulfite.

9. The process of claim 8 wherein said copper sulfide depressant is added to said concentrate in an amount equal to from about 1 to about 5 pounds per ton of solids in said concentrate.

10. The process of claim 9 wherein activated carbon is added to said concentrate prior to said separation.

11. A process for separating molybdenite from a molybdenite-containing copper sulfide concentrate by a flotation process wherein said molybdenite is selectively floated by use of a sulfite or bisulfite compound as a copper sulfide depressant, said process comprising:

(a) adjusting the pH of said concentrate to a value from about 3.0 to about 7.0 by adding sulfuric acid to said concentrate;

(b) adding said copper sulfide depressant to said concentrate in an amount sufficient to inhibit the flotation of said copper sulfide during aeration of said concentrate;

(c) aerating said concentrate to float said molybdenite; and, (d) separating said floated molybdenite from said concentrate.

12. The process of claim 11 wherein said copper sulfide depressant is selected from the group consisting of alkali metal sulfites and alkali metal bisulfites.

13. The process of claim 11 wherein said copper sulfide depressant is sodium sulfite or sodium bisulfite.

14. The process of claim 11 wherein said copper sulfide depressant is added in an amount from about 1 to about 5 pounds per ton of solids in said concentrate.

15. The process of claim 11 wherein activated carbon is added to aid concentrate prior to said separation.

16. The process of claim 11 wherein said pH value is from about 5.0 to about 6.0.

17. A process for separating molybdenite from a molybdenite-containing copper sulfide concentrate by a flotation process wherein said molybdenite is selectively floated by use of sulfite or bisulfite compound as a copper sulfide depressant, said process comprising:

(a) adjusting the pH of said concentrate to a value from about 3.0 to about 7.0 and forming said sulfite or bisulfite compound in said concentrate with sulfur dioxide;

(b) aerating said concentrate to float said molybdenite; and, (c) separating said floated molybdenite from said concentrate.

18. The process of claim 17 wherein said pH value is from about 5.0 to about 6.0.

19. The process of claim 17 wherein activated charcoal is added to said concentrate prior to said separation.

* * * * *